United States Patent [19]

Conti

[11] Patent Number: 4,757,737

[45] Date of Patent: Jul. 19, 1988

[54] WHISTLE SYNTHESIZER

[76] Inventor: Ugo Conti, 7658 Leviston Ave., El Cerrito, Calif. 94530

[21] Appl. No.: 844,930

[22] Filed: Mar. 27, 1986

[51] Int. Cl.[4] ..... G10H 1/057; G10H 1/12

[52] U.S. Cl. ..... 84/1.12; 84/1.13; 84/1.21; 84/1.26

[58] Field of Search ..... 84/1.01, 1.19, 1.12, 84/1.21, 1.22, 1.11, 1.24, DIG. 27, 1.13, 1.26; 340/347 AD

[56] References Cited

U.S. PATENT DOCUMENTS

| | | | |
|---|---|---|---|
| 3,429,976 | 2/1969 | Tomcik | 84/1.12 |
| 3,767,833 | 10/1973 | Noble et al. | 84/1.01 |
| 3,911,776 | 10/1975 | Beigel | 84/1.11 |
| 3,986,426 | 10/1976 | Faulhaber | 84/1.26 X |
| 4,085,646 | 4/1978 | Naumann | 84/1.09 |
| 4,119,006 | 10/1978 | Whitefield | 84/1.13 |
| 4,168,645 | 9/1979 | Squire et al. | 84/1.01 |
| 4,193,332 | 3/1980 | Richardson | 84/1.26 |
| 4,195,544 | 4/1980 | Koike | 84/1.19 |
| 4,202,237 | 5/1980 | Håkansson | 84/1.24 |
| 4,212,221 | 7/1980 | Woron | 84/1.26 |
| 4,250,789 | 2/1981 | Tavel | 84/1.22 |
| 4,271,743 | 6/1981 | Uchiyama | 84/1.26 |
| 4,433,604 | 2/1984 | Ott | 84/1.24 |
| 4,463,650 | 8/1984 | Rupert | 84/1.19 |

*Primary Examiner*—Stanley J. Witkowski

*Attorney, Agent, or Firm*—Townsend and Townsend

[57] ABSTRACT

A whistle synthesizer comprises a microphone, a housing, system electronics within the housing, and controls outside the housing. The player whistles into the microphone, the signals from which are processed to provide an instrument output signal suitable for communication to an external amplifier. The controls are located within easy reach of the player so that they may be manipulated all the while the player is whistling.

12 Claims, 17 Drawing Sheets

WHISTLE SYNTHESIZER

FIELD OF THE INVENTION

The present invention relates generally to electronic musical instruments such as synthesizers.

BACKGROUND OF THE INVENTION

With the age of electronics has come the age of electronic music. While purists may shriek in horror at some of the recent developments, they should remember that innovation and changes are healthy, if not always comfortable. After all, today's avant-garde music is tomorrow's elevator music.

One recent development is the synthesizer, and the prior art is replete with examples. In broad terms, the synthesizer allows the musician to define and refine the characteristics of a note in time domain (attack and decay) and in frequency domain (timbre). Since these are the very characteristics that differentiate the sound of a guitar from that of a piano, the synthesizer can be made to produce the sounds of known instruments as well as other sounds. Most synthesizers utilize a standard piano keyboard as the input device. Thus, the synthesizer has provided the musician, able to play only the piano, with all the instruments of the orchestra at his or her fingertips.

Of course, not everyone plays a piano. For those who do not, but do play wind instruments, synthesizers based on wind instruments have been developed. Some versions have a transducer built into a more-or-less standard instrument. These sense the actual acoustic vibrations, and construct sounds based on the sensed vibrations. In other wind instrument devices, the portions of the instrument that actually produce the vibrating column of air are dispensed with, but the keys or buttons remain. These devices have a mouthpiece of sorts, and sense parameters such as air velocity. These parameters, when combined with information on key or button depressions, allow the note to be determined. Thus the wind musician too can have all the instruments of the orchestra at his or her fingertips.

Of course, not everyone plays a piano or a wind instrument. For those who do not, but do sing, synthesizers for using a voice input have been developed (or at least proposed). U.S. Pat. No. 4,463,650 to Rupert discloses such a device. The voice input is sensed, and the fundamental frequency determined by a zero-crossing analysis. Depending on the type of instrument to be simulated, the appropriate waveform from a digital memory is read out at a clock rate determined by the voice frequency. However, the human voice has a much more complex waveform than does a vibrating reed, and for all but a trained female voice, it is no small technical feat to extract the fundamental frequency correctly and reliably.

Of course, not everyone plays a piano or a wind instrument or has a trained female voice.

SUMMARY OF THE INVENTION

The present invention provides an electronic instrument that requires neither a decent singing voice nor the ability to play the piano or a wind instrument.

In brief, the present invention utilizes the oft-overlooked music-making capability possessed by most people, namely the ability to whistle. Although there are some whistlers who possess astounding technique, and perform publicly, the whistle is generally not a shared form of musical entertainment. The reason is simple—the whistle is too pure in tonal color and too high in pitch to be pleasant to anyone other than the whistler. The whistle tone has none of the rich characteristics displayed by conventional musical instruments or the human singing voice. The result is that most people who whistle do so in the privacy of the shower or while working outdoors.

The present invention exploits the whistle's first-mentioned weakness, namely excess purity, as a virtue, in that a whistle is capable of having its fundamental frequency determined very reliably and very quickly. The invention overcomes the second weakness, namely the high pitch, by frequency division.

The instrument comprises a microphone, a housing, system electronics within the housing, and controls outside the housing. The player whistles into the microphone, the signals from which are processed to provide an instrument output signal suitable for communication to an external amplifier. The controls are located within easy reach of the player so that they may be manipulated all the while the player is whistling.

The electronic subsystems of the present invention comprise a whistle processor, a voice component signal ("VCS") generator, a tone definition stage, and an output stage. The whistle processor circuitry is responsive to a whistle signal from the microphone, and provides a number of derived signals containing frequency, amplitude, and zero-crossing information. On the basis of frequency and zero-crossing information, the VCS generator provides a number of periodic signals (including both sinusoidal and non-sinusoidal signals) at selected subharmonics of the whistle fundamental (including octave and other divisions). These signals (the voice component signals) are communicated to the tone definition stage. Groups of the voice component signals are combined into a smaller number of instrument voices, filtered, and then communicated to the output stage. The output stage shapes the amplitude envelope of the output signal, either with the actual envelope of the whistle signal or a transient triggered by the onset of the note. The output stage may further prolong the output beyond the natural duration of the whistled note to provide a more gradual decay.

The present invention gives the player instant access to almost unlimited tonal variations. The controls allow the player to vary the proportions of voice component signals, to selectively pass certain frequency bands in the different voices, and to modify the note attack and decay, all in real time. The voice component signals are generated in precise synchronism with the zero crossings of the whistle so that the frequency information is immediately transferred to the lower registers without loss of subtlety or expression.

A further understanding of the nature and advantages of the present invention may be realized by reference to the remaining portion of the specification and the attached drawings.

BRIEF DESCRIPTION OF THE DRAWINGS

FIGS. 17A–B are plan views of the instrument keyboard.

DESCRIPTION OF THE PREFERRED EMBODIMENT

System Overview

Figure 1:
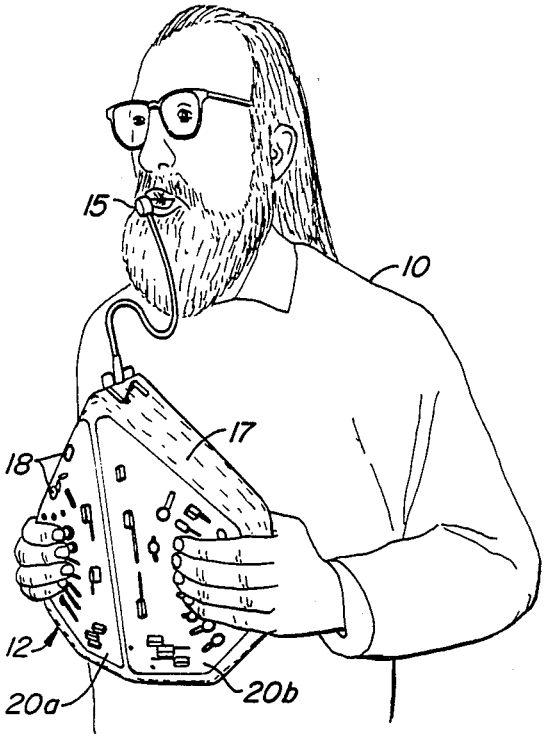
FIG. 1 is a pictorial view of a user playing the instrument of the present invention.

FIG. 1 is a pictorial view illustrating a player 10 playing an instrument 12 according to the present invention. The instrument includes a microphone 15, a housing 17, system electronics (to be described below) within the housing, and a set of controls 18 outside the housing. In brief, player 10 whistles into a microphone 15, and the microphone signals are communicated to the system electronics. The system electronics provides one or more signals that are communicated to an external amplifier (not shown) for conversion to an acoustic output. In the preferred embodiment, the instrument provides a two-channel (stereo) output.

The instrument is supported in front of the player, typically by means of a saxophone strap or the like. Controls 18 are preferably arranged on a pair of control panels 20*a* and 20*b* with the most frequently used controls falling naturally under the player's fingers when he grips the instrument in a relaxed manner.

As the player whistles, he manipulates controls 18 to define and alter the temporal and frequency characteristics of the notes. An important aspect of the present invention is that the player can manipulate controls 18 all the while he is playing, and therefore can shape and define the tonal quality of the notes in real time. The controls include slide potentiometers and switches for conditioning and selectively enabling portions of the circuitry. A description of the specific nature of the controls is provided below along with the description of the circuits with which the controls are associated.

Figure 2:
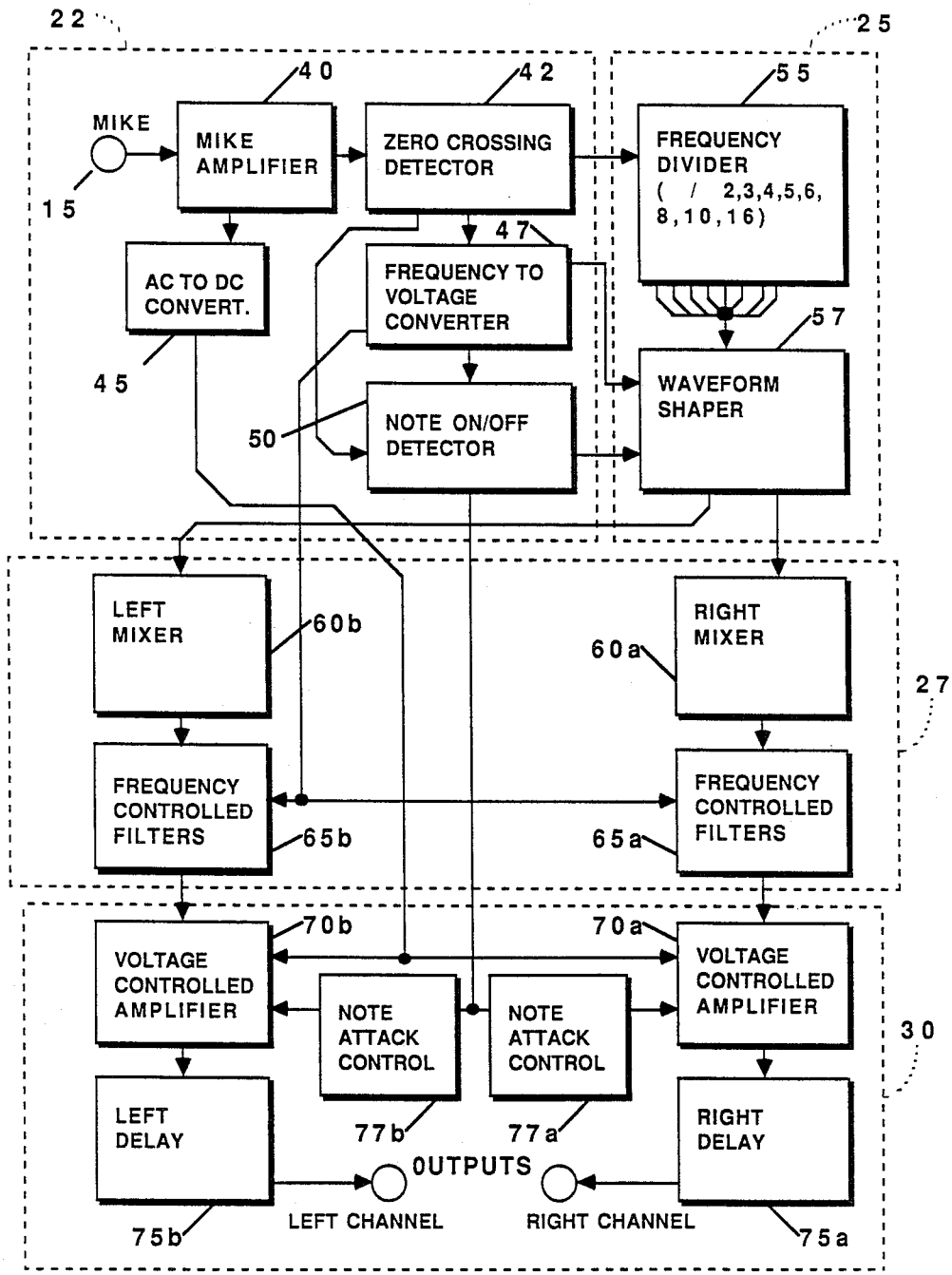
FIG. 2 is a block diagram of the system electronics of the present invention.

FIG. 2 is a block diagram illustrating the system electronics of instrument 12. The basic subsystems include a whistle processor 22, a voice component signal ("VCS") generator 25, a tone definition stage 27, and an output stage 30. In operation, whistle processor 22 receives an analog signal from microphone 15 and generates a number of derived signals containing information regarding the amplitude envelope, frequency, and zero crossings. These signals are communicated to VCS generator 25, which provides a number of sine waves and square waves at selected subharmonics of the whistle fundamental. These subharmonic signals, referred to as the voice component signals ("VCS"), are the basic building blocks from which the tonal edifice of the present invention is constructed. They are communicated to tone definition stage 27, which determines the particular superpositions and harmonic content of the output. The signals from tone definition stage 27 are communicated to output stage 30, which determines the time evolution of the instrument output.

The whistle provides a relatively pure tone in the frequency range of about 400–3200 Hz, which can be handled by most microphones. A noise-cancelling microphone is preferred since it allows the whistle to be sensed while rejecting extraneous sounds. It should be noted that acoustic feedback is not a problem, since the sounds entering the microphone are frequency divided before exiting the external amplifier. Thus, the player can locate himself immediately in front of the external amplifier, should he so desire.

Whistle processor 22 comprises a microphone amplifier 40, a zero crossing detector 42, an AC-to-DC convertor 45, a frequency-to-voltage convertor 47, and a note on/off detector 50. The sound generated by the whistler is detected by microphone 15 and amplified by microphone amplifier 40. The amplified signal, referred to as the whistle signal, is communicated to zero crossing detector 42 and AC-to-DC convertor 45. Zero crossing detector 42 produces a square wave with sharp transitions closely corresponding to those of the whistle signal. This square wave, referred to as the frequency reference signal $F_0$, is communicated to frequency-to-voltage convertor 47, note on/off detector 50, and VCS generator 25. The threshold setting for zero crossing detector 42 is controllable by the player to define the overall instrument sensitivity. Frequency-to-voltage convertor 47 provides a voltage level, referred to as the frequency voltage $V_f$, which is communicated to note on/off detector 50, VCS generator 25, and tone definition stage 27. AC-to-DC convertor 47 generates an analog signal $V_a$ corresponding to the amplitude envelope of the whistle signal, and communicates this to output stage 30. Note on/off detector 50 detects the beginning and end of the whistle signal and generates a digital note-on signal, designated $N_c$, which is asserted at the beginning of a note and withdrawn at the end. This signal is communicated to VCS generator 25 and output stage 30.

VCS generator 25 comprises a frequency divider 55 and a waveform shaper 57. Frequency divider 55 receives frequency reference signal $F_0$ and produces a number of square waves at selected subharmonics of the fundamental frequency. In the preferred embodiment, these represent frequency divisions by factors of 2, 3, 4, 5, 6, 8, 10, and 16. These square waves are generated by standard digital frequency division, and so are automatically generated with duty cycles of 50% (the frequency reference signal has a duty cycle slightly different from 50%). Moreover, the square waves are biased so that they alternate between positive and negative levels (+6 volts and −6 volts). The eight square waves are sent to waveform shaper 57, which performs a double function. First, it is responsive to note-on signal $N_c$, and truncates the square waves so that when $N_c$ is withdrawn (signifying the end of the note), the square wave signals are referred to ground potential. Second, waveform shaper 57 includes frequency-controlled filters responsive to the frequency voltage $V_f$, and converts at least some of the subharmonic square waves into sinusoidal signals at the same frequency. The output from waveform shaper 57 is a plurality of periodic signals, referred to as voice-component signals ("VCS" for short), which include square waves and sine waves (pure tones).

Tone definition stage 27 operates on the voice component signals to provide four signals, referred to as voice signals (or simply "voices"). Each voice is a superposition of a respective associated subset of the voice component signals, and is for the most part controllable independently of the other voices. The voice component signals that make up each of the voices are as follows:

| | | | |
|---|---|---|---|
| Voice 1: | sine ½ | Voice 2: | square ½ |
| | sine ¼ | | square ¼ |
| | sine ⅛ | | square ⅛ |
| | | | square 1/16 |
| Voice 3: | square ⅛ | Voice 4: | sine ⅓ |
| | sine 1/16 | | square 1/6 |
| | square 1/16 | | square 1/5 |
| | | | square 1/10 |

Voices 1 and 2 are processed and output from the right channel; voices 3 and 4 from the left channel.

The right channel circuitry of tone definition stage 27 includes a right mixer 60*a* for voices 1 and 2 and a right frequency-controlled filter 65*a* for voice 2. The left channel circuitry includes a left mixer 60*b* for voices 3 and 4 and left frequency-controlled filters 65*b* for voices 3 and 4. Mixers 60*a–b* and frequency-controlled filters 65*a–b* are controllable by the player to allow each of the voices to be changed in tonality.

The voice signals, as possibly modified by filters 65*a–b*, are referred to collectively as the filtered voice signals, and are communicated to output stage 30. Output stage 30 includes right and left voltage-controlled amplifiers ("VCA's") 70*a* and 70*b*, right and left delay circuits 75*a* and 75*b*, and right and left note-attack control circuits 77*a* and 77*b*.

Each VCA includes cascaded first and second VCA stages. The filtered voice signals in each channel are combined and communicated to the signal input of the first VCA stage, the output of which is communicated to the second VCA stage. The first VCA stage gain is controlled by the output of the note-attack control circuits; the second stage gain is controlled by amplitude envelope signal $V_a$. Each of note-attack control circuits 77*a–b* is responsive to the note-on signal $N_c$, and generates a transient at the beginning of each note that may be used to establish an alternate envelope. Note-attack control circuits 77*a–b* are individually controllable by the player to establish whether the transients are to be imposed, and if so, how sharp they are to be. Thus, the player can impose a sharp attack and rapid decay on the signal in one channel while having the other channel follow the actual amplitude envelope.

The signals from VCA's 70*a–b* are sent to delay circuits 75*a–b* respectively, which produce acoustic delays controlled by the player. The player can thus prolong the output signal beyond the duration of the amplitude envelope and provide a more gradual decay. The two channel outputs are available, and are typically communicated to a guitar amplifier or the like for further processing and sound reinforcement outside instrument.

While the specific circuitry can be implemented in many ways, any design must be based on a recognition of the nature of the whistle input. The whistle is highly transitional in nature; a reasonably skilled whistler can produce trills, staccato notes, and other effects on a time scale on the order of 20 milliseconds. The circuitry must not impose delays that could cause a loss of correlation between the whistle input and the instrument output. The embodiment specifically disclosed meets the requirement. The voice component signals are generated directly from the frequency reference signal, so that the voice signals, and therefore the instrument output, follow the whistle input in real time. While the frequency division inherently averages certain high frequency fluctuations, the essential characteristics and nuances of the input are transferred to lower frequency intact.

Circuit Details

Figure 3:
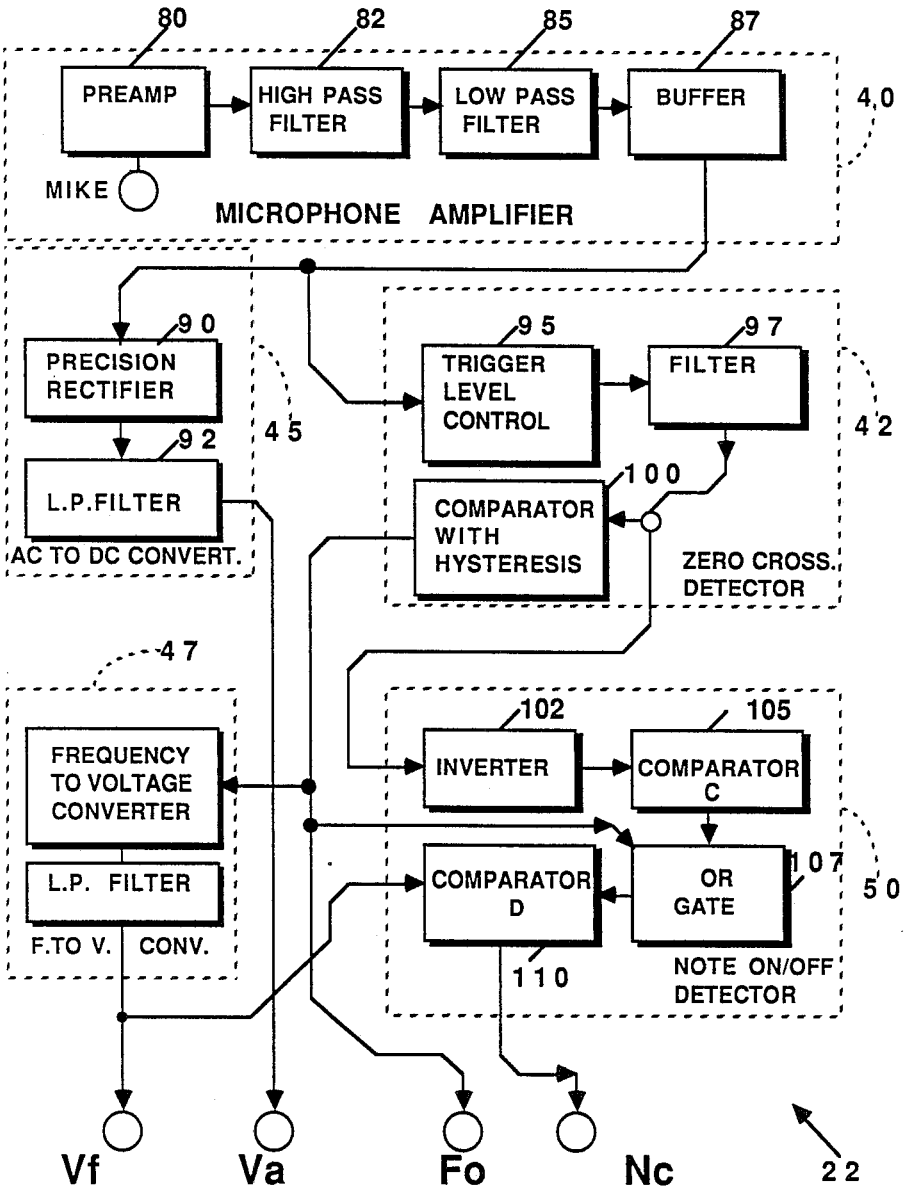
FIG. 3 is a detailed block diagram of the whistle processor.

FIG. 3 is a detailed block diagram of whistle processor 22. Microphone amplifier 40 includes a preamplifier 80, high pass and low pass filters 82 and 85, and a buffer 87, which operate to produce a signal having an amplitude of approximately 3–4 volts. AC-to-DC convertor 47 includes a precision rectifier 90 and a low pass filter 92, which rectify and filter the signal from buffer 87 to extract the amplitude envelope. Frequency-to-voltage convertor 47 produces the frequency voltage $V_f$, which varies linearly with frequency with a coefficient of approximately 1 mv/Hz.

Zero crossing detector 42 includes a trigger level control 95, a filter 97, and a comparator 100. Trigger level control 95 is adjustable by the player to communicate a renormalized signal from buffer 87 through filter 97 to comparator 100. Comparator 100 is thresholded by a fixed voltage (approximately 0.6 volts) so that the comparator output goes high only when the renormalized whistle signal exceeds a 0.6 volts. Comparator 100 is provided with hysteresis so that the comparator output goes low when the renormalized signal falls below about 0.3 volts. The signal at the comparator output is the frequency reference signal $F_0$, a square wave of the same frequency as the whistle and a duty cycle slightly less than 50% (due to the non-zero threshold of the comparator).

Note on/off detector 50 includes an invertor 102, a comparator 105, an OR gate 107, and a comparator 110. The output from filter 97 is inverted at invertor 102 and the complementary signal thus generated is communicated to comparator 105, which is thresholded by the same fixed voltage as comparator 100. The result is a square wave that is generally complementary to the frequency reference signal, but also has a duty cycle slightly less than 50%. These two square waves are combined at OR gate 107 to produce a square wave at twice the reference frequency and close to 100% duty cycle. The signal from OR gate 107 is communicated to comparator 110 which is thresholded by a signal corresponding to the frequency voltage. Comparator 110 fills in the gaps to provide an output that is high whenever frequency reference signal $F_0$ is present and quickly goes low when $F_0$ disappears. This output is note-on signal $N_c$.

Figure 4:
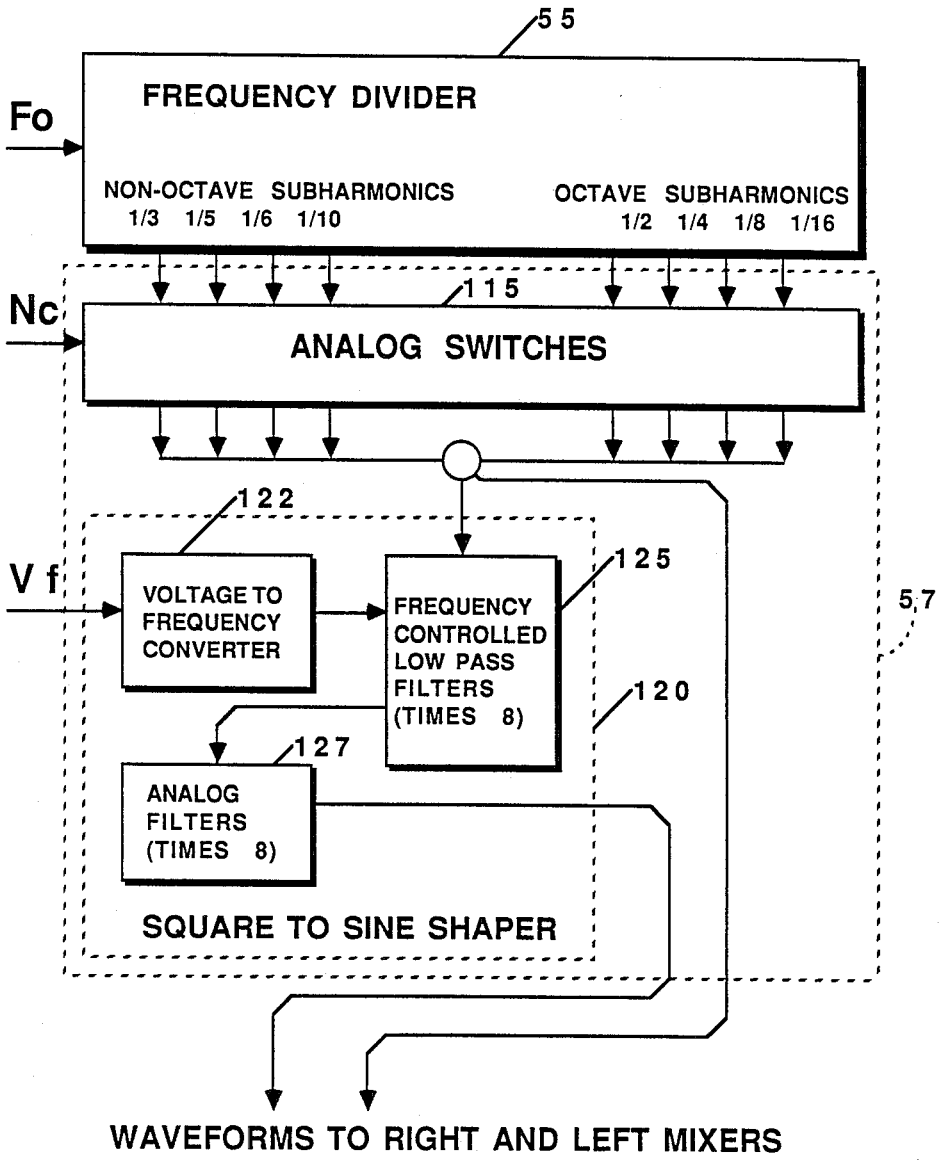
FIG. 4 is a detailed block diagram of the VCS generator.

FIG. 4 is a detailed block diagram of VCS generator 25. Waveform shaper 57 includes a bank of analog switches 115, and a square-to-sine convertor 120. Convertor 120 includes a voltage-to-frequency convertor 122, a bank of frequency-controlled filters 125, and a bank of analog filters 127.

The digitally divided square waves are passed through analog switches 115, which are conditioned by note-on signal $N_c$. Because the division is digital in nature, the subharmonic signals do not necessarily return to "low" when the whistle stops. Indeed, the Nth subharmonic will only return to low when the duration of fundamental is an exact multiple of N cycles. Otherwise it stays high, and when it is converted into a sound, a distinct and very annoying click will be heard. The analog switches eliminate this click by referring the subharmonic square waves to ground when the note-on signal is withdrawn.

A number of the subharmonic square waves, namely those for which pure tones are required, are communicated to respective frequency-controlled filters 125. Voltage-to-frequency convertor 122 is responsive to the frequency voltage $V_f$ and provides a clock signal at a multiple (50 times) of the whistle frequency. Each of the filters has an associated divider so that it receives a clock at 50 times the appropriate subharmonic. Each filter's pass band is centered at the appropriate subharmonic. Since the ultimate timing is generated by the whistle frequency, the filters all track the frequency of the whistle. The filters are high-Q filters (Q on the order of 10) so that substantially all the harmonics are eliminated from the square waves. The outputs from frequency-controlled filters 125 are communicated through analog filters 127, to produce almost pure sine waves related precisely to the whistle frequency by the particular subharmonic ratios.

Figure 5:
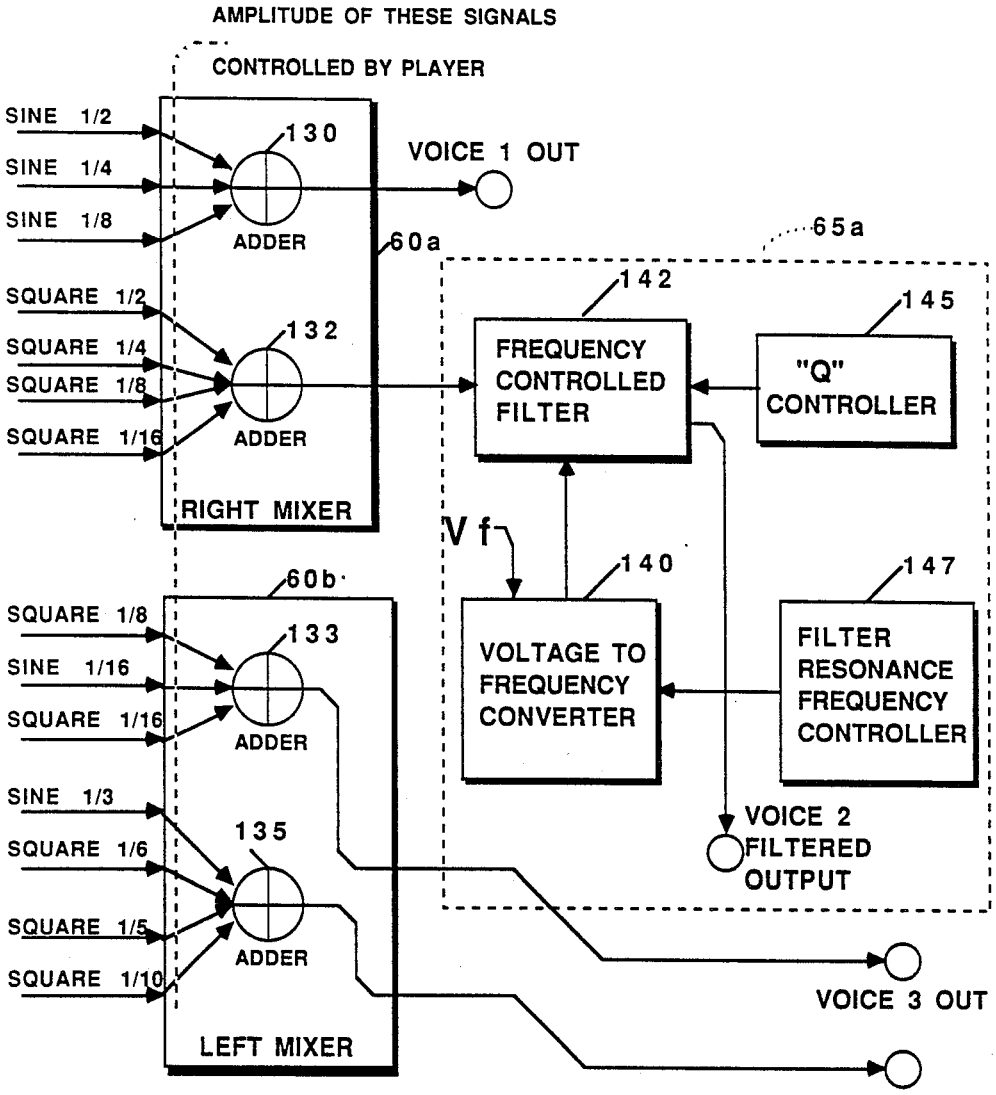
FIG. 5 is a detailed block diagram of the tone definition stage.

FIG. 5 is a detailed block diagram of tone definition stage 27. Particular subcombinations of the voice component signals are combined at adders 130 and 132 in right mixer 60*a* to produce voices 1 and 2, and at adders 133 and 135 in left mixer 60*b* to produce voices 3 and 4. The mixers are controllable by the player to establish the particular ratios of signals within each voice. Voices 2–4 are subjected to a further filtering step, also controllable by the player. In a manner similar to that used in the square-to-sine convertors, a voltage-to-frequency convertor 140, controlled by $V_f$, provides a clock that controls a frequency-controlled filter 142. A Q-controller 145 allows the player to establish the bandwidth of the filter, while a resonance frequency controller 147 allows the player to establish the portion of the spectrum (relative to the fundamental) that will be passed. More particularly, the clock frequency that is applied to filter 142 is proportional to the fundamental frequency, but with a multiplier that is controllable by the player. Thus, when controls 145 and 147 are set by the player, filter 142 modifies the input voice in a corresponding manner, and stays tuned to the whistle frequency to modify all notes in the same way. As with all the controls, the player can manipulate these to shape the notes in real time.

Figure 6:
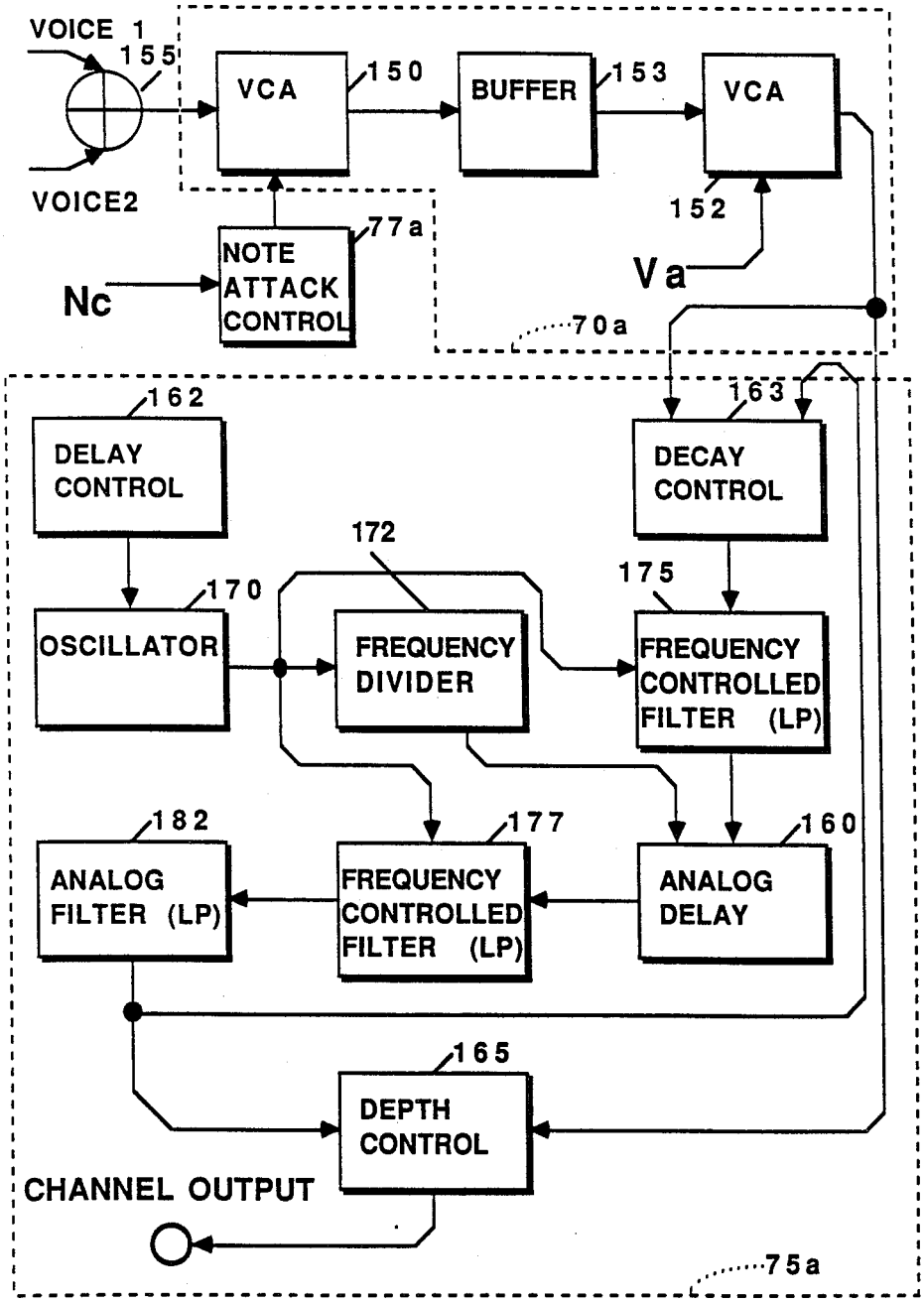
FIG. 6 is a detailed block diagram of the output stage.

FIG. 6 is a detailed block diagram of the right channel of output stage 30. The left channel is essentially the same. Voltage controlled amplifier ("VCA") 70*a* comprises first and second VCA stages 150 and 152 and an intervening buffer 153. The voice 1 and voice 2 signals (the latter being a filtered voice signal) are combined at an adder 155 and communicated to the signal input of VCA stage 150. The gain of VCA stage 150 is established by note attack control circuit 77*a* which, when enabled, produces a transient at the beginning of the note (whenever note-on signal $N_c$ makes a transition from low to high). The output of VCA stage 150 is communicated through buffer 153 to the signal input of VCA stage 152, the gain of which is established by amplitude envelope signal $V_a$. Thus, in the event that note attack control 77*a* is enabled, only the beginning of the note is communicated to VCA stage 152, whereupon a percussive sound is achieved. If note attack control control 77*a* is disabled, VCA stage 150 is a constant gain stage so that the time dependence of the signal is established at VCA stage 152 and follows the whistle signal.

The output from VCA 70*a* is communicated to delay circuitry 75*a*, which operates to combine the signal with one or more delayed versions of the signal to produce reverberation effects and provide a gradual decay, if desired. To this end, the signal is communicated to the output directly and also through a bucket brigade delay element 160. The parameters of the delay circuitry are controlled by the player through a delay control 162, a decay control 163, and a depth control 165. The delay interval provided by delay element 160 is controlled by the clock output of an oscillator 170, as divided (by a factor of 8) at a frequency divider 172. Because of the sampled nature of the signal processed in delay element 160, the delay element is preceded by a low pass filter 175 to avoid aliasing effects, and is followed by a low pass filter 177 to cancel the steps created by the sampling mechanism. Filters 175 and 177 are frequency-controlled filters operated by the same clock output of oscillator 170, so there are no aliasing problems or beats between the filters and the delay element. The delayed signal is finally passed through a simple analog low pass filter 182. The setting of delay control 162 establishes the clock frequency and hence the delay interval. The delayed signal is recirculated through the delay element, with the degree of recirculation being established by the setting of decay control 163. The delayed signal is combined with the non-delayed signal, with the relative proportion being established by the setting of depth control 165. Thus, while the whistled note is characterized by a rather sharp cutoff, the player can prolong the note and establish a more gradual decay.

FIGS. 7–15 are circuit schematics illustrating a preferred circuit implementation for the present invention. Since the circuitry has been described in considerable detail above, only occasional features will be noted.

Figure 7:
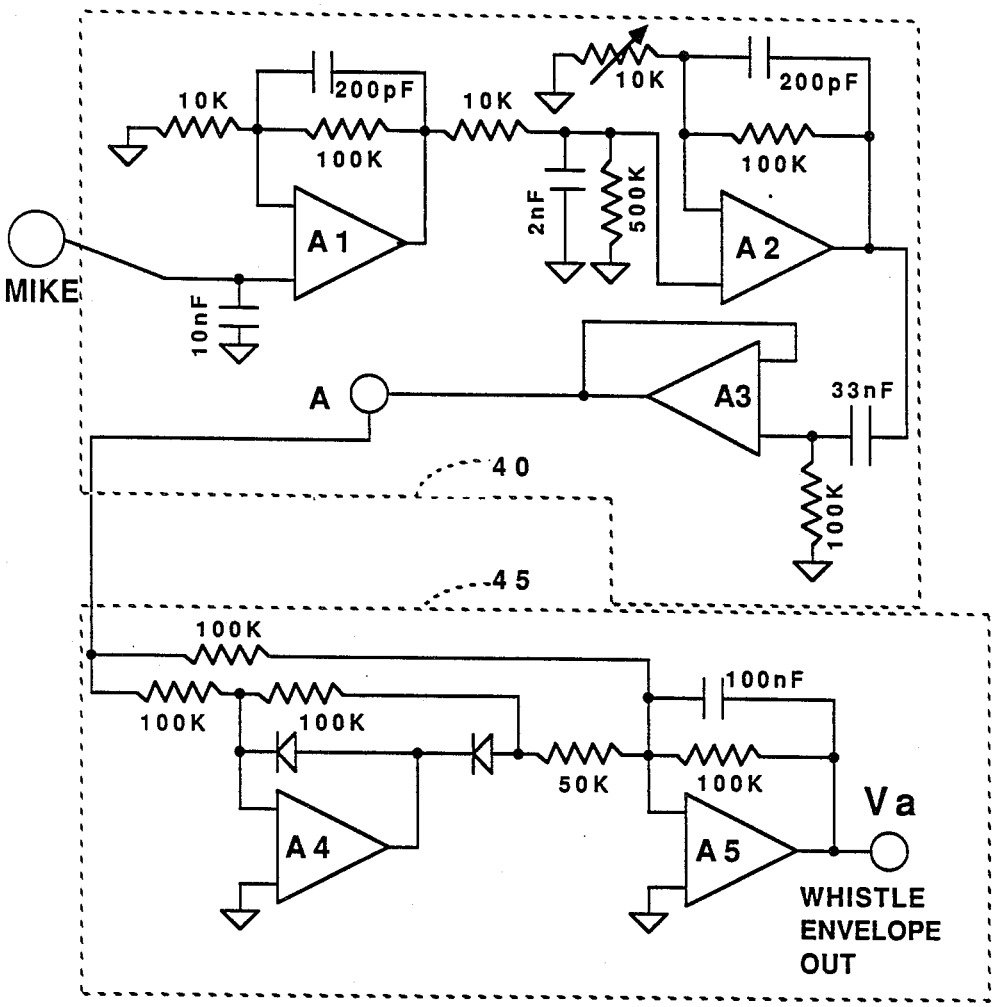
FIGS. 7–15 are circuit schematics of the system electronics.
Figure 8:
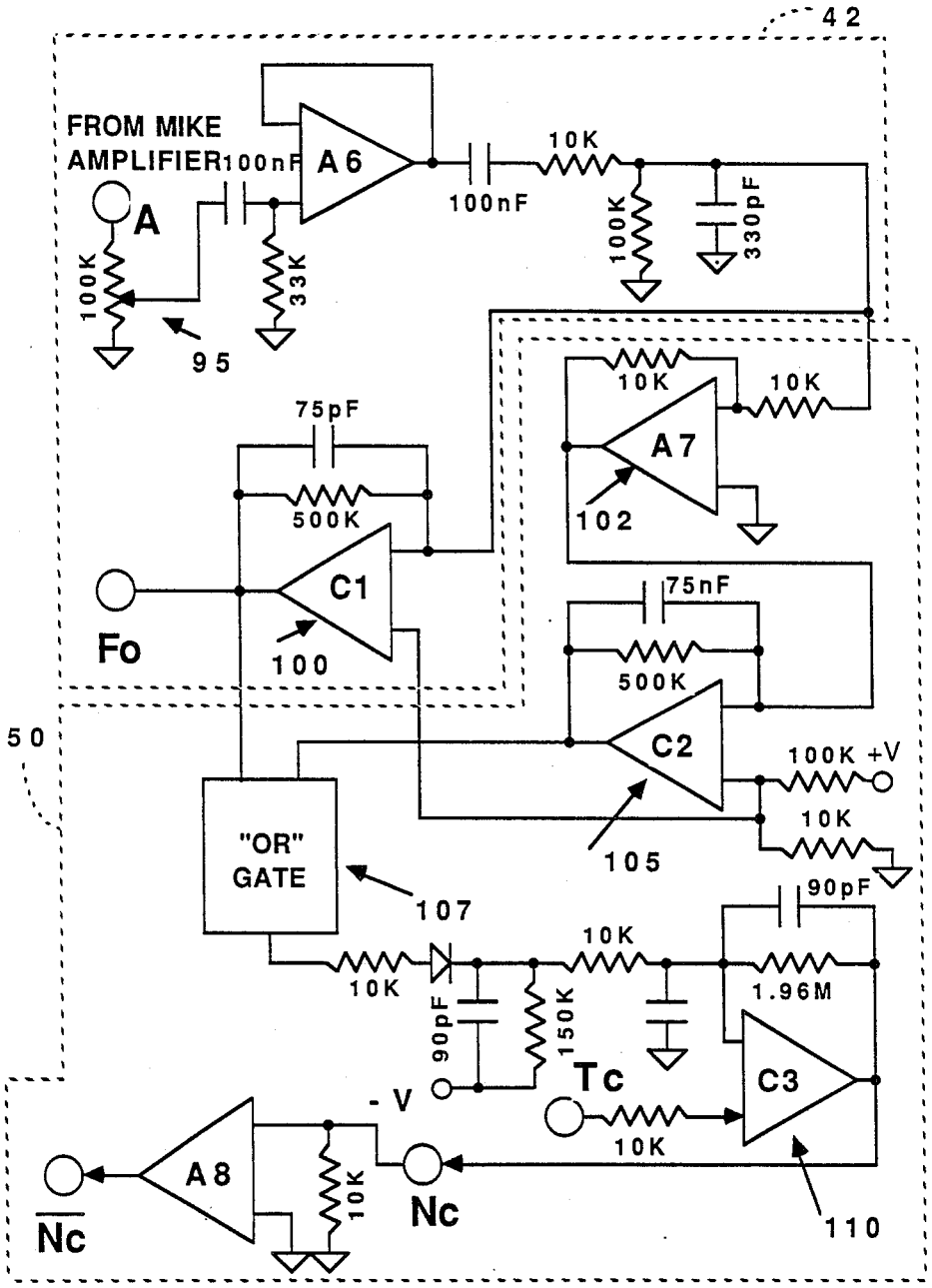

FIG. 7 is a circuit schematic illustrating microphone amplifier 40 and AC-to-DC convertor 45. FIG. 8 is a circuit schematic of zero crossing detector 42 and note on/off detector 50.

Figure 9:
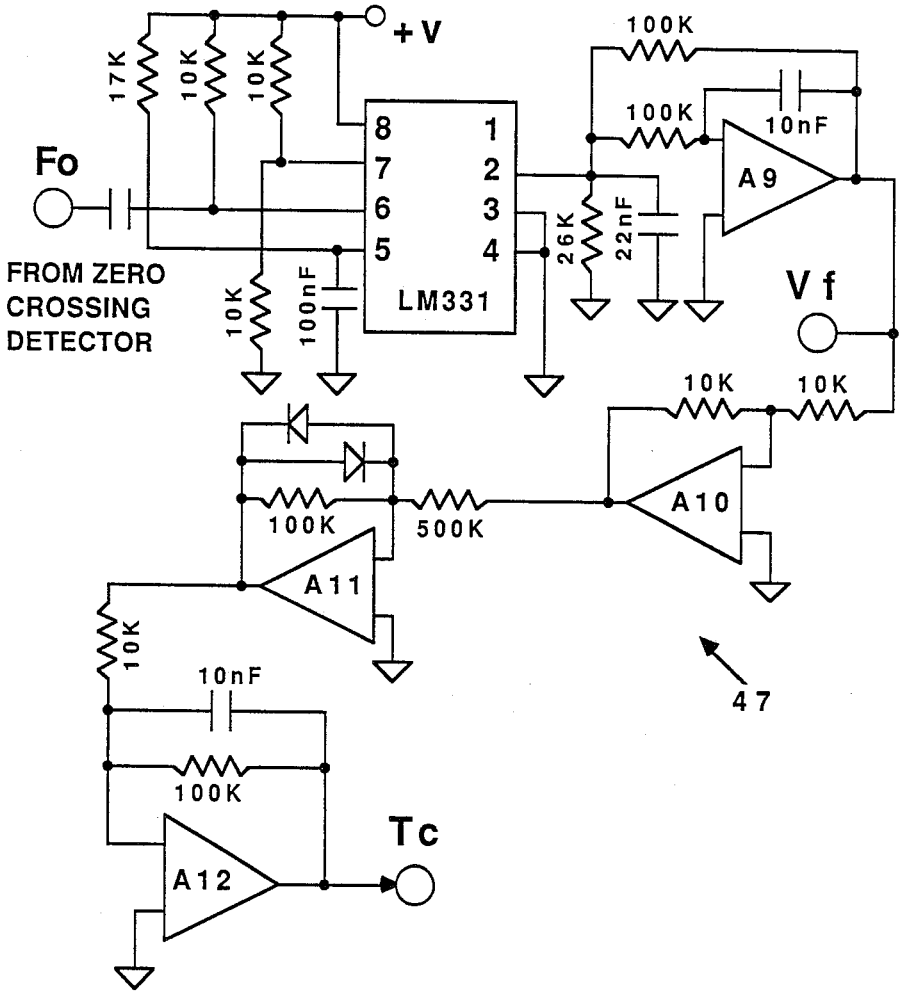

FIG. 9 is a circuit schematic of frequency-to-voltage convertor 47. In addition to producing the frequency voltage $V_f$, which varies linearly with frequency, it provides a voltage $T_c$, used as one of the inputs for comparator 110 in note on/off detector 50. This voltage has a generally logarithmic characteristic.

Figure 10:
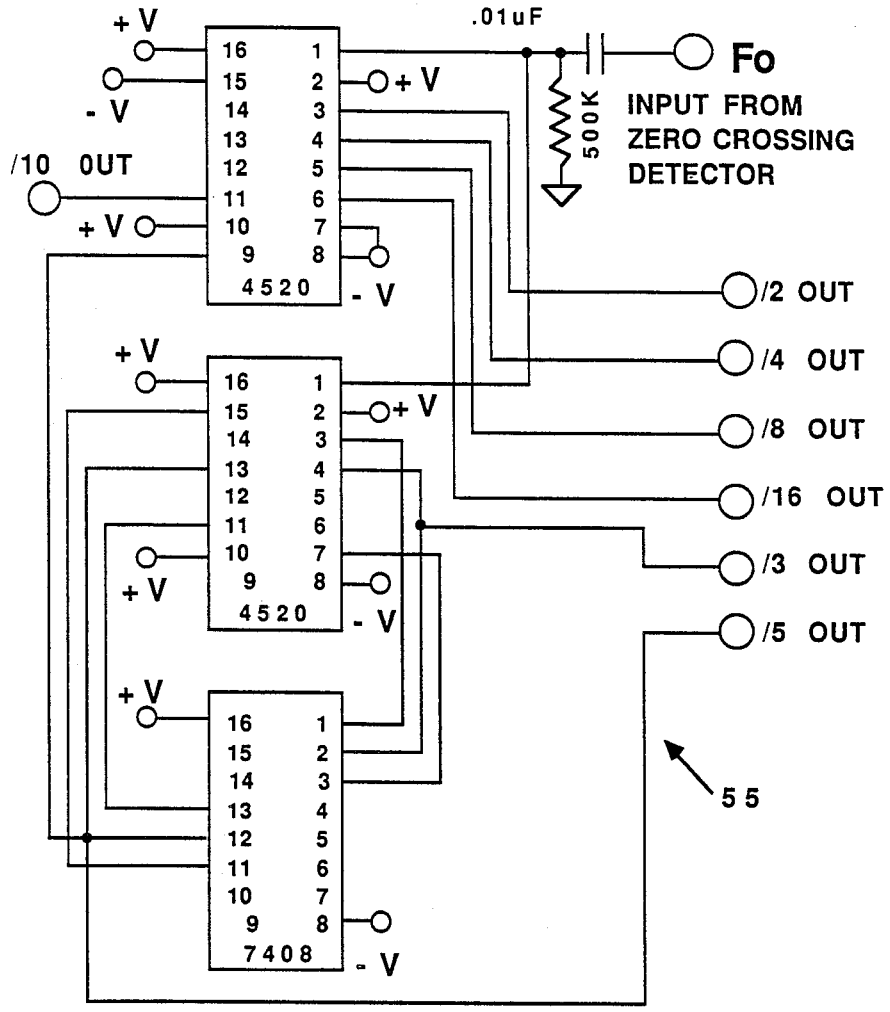

FIG. 10 is a circuit schematic of frequency divider 55. The circuitry is implemented with standard integrated circuits. The divisions by powers of 2 are provided in a single chip for that purpose. The odd divisions are provided by additional logic in a manner well known in the art.

Figure 11:
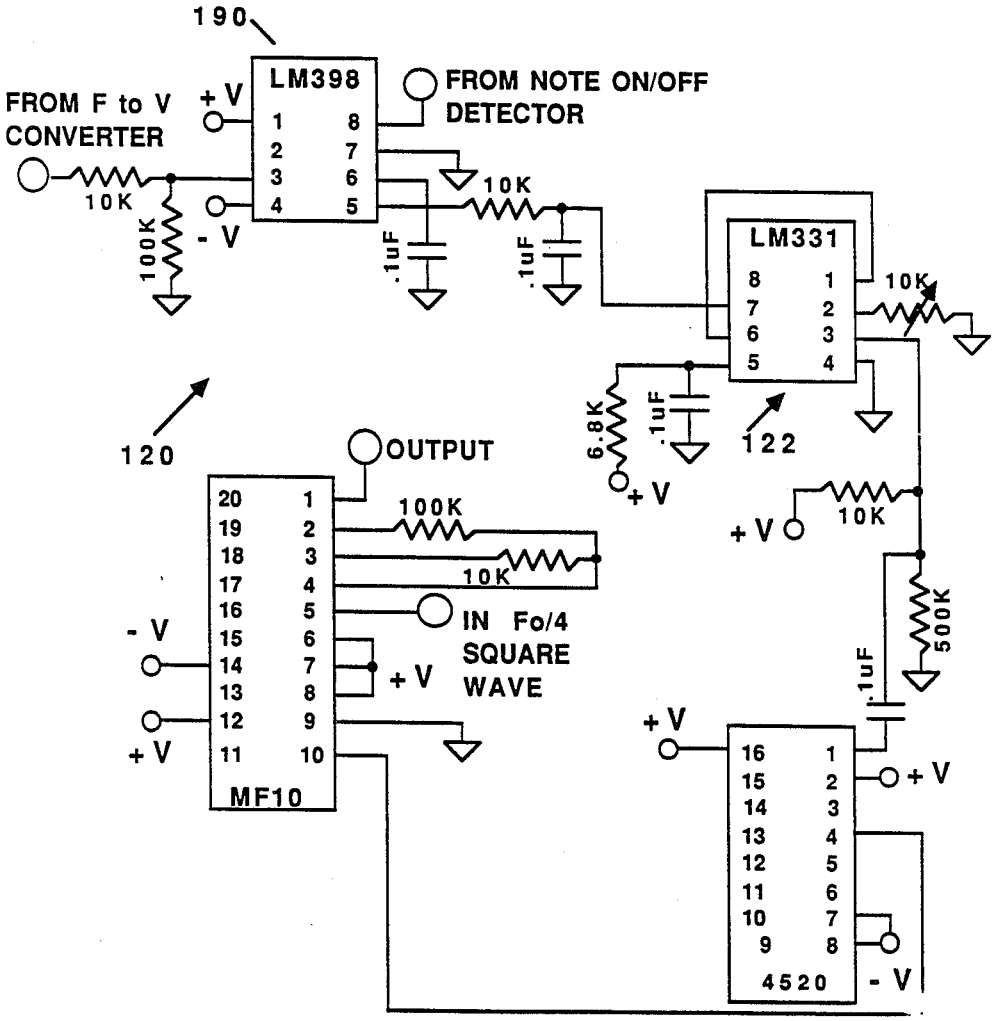

FIG. 11 is a circuit schematic of portions of square-to-sine convertor 120. The frequency voltage $V_f$ is communicated to voltage-to-frequency convertor 122 through a track and hold amplifier 190 which operates to hold the level beyond the end of the note in order to keep the filter characteristic constant during the entire note. The Q-value for the filter is set by means of a fixed voltage divider. Voltage-to-frequency convertor 122 provides a clock at approximately 50 times the fundamental frequency, and this clock is used to control all the filters, with appropriate divisions depending on the particular subharmonic being filtered.

Figure 12:
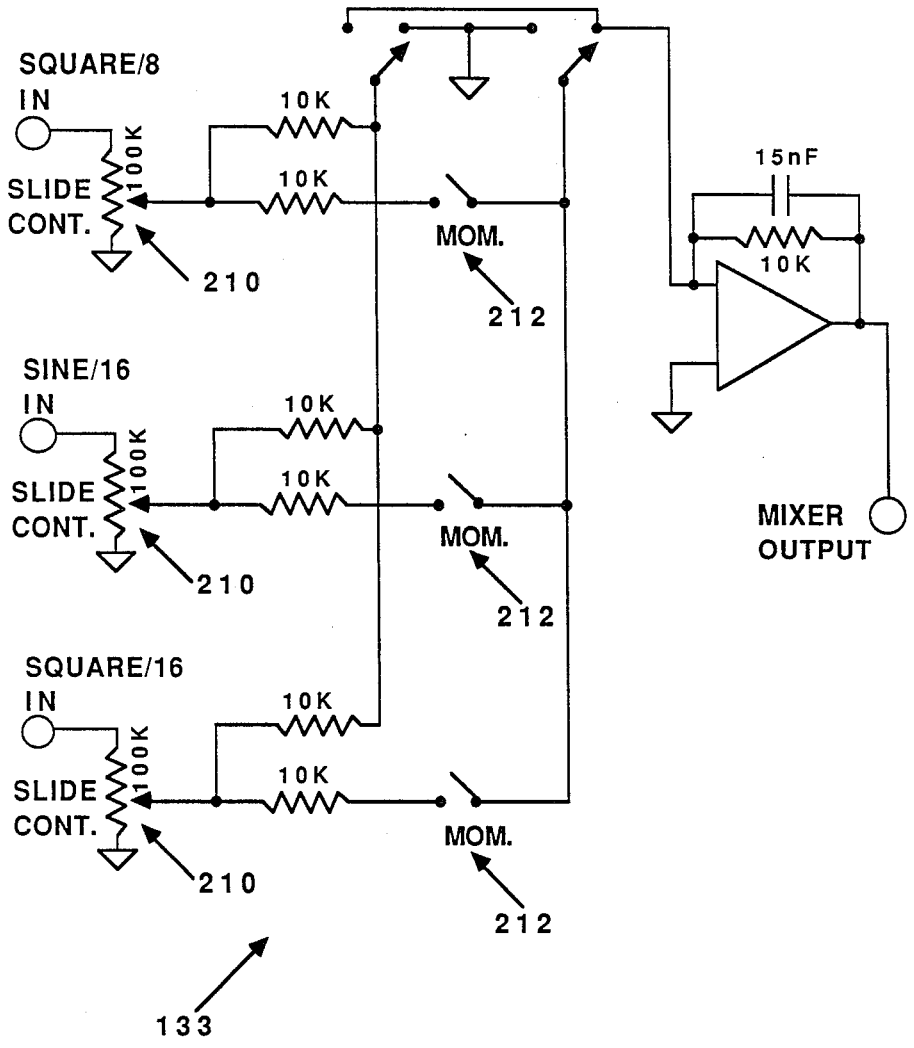
Figure 13:
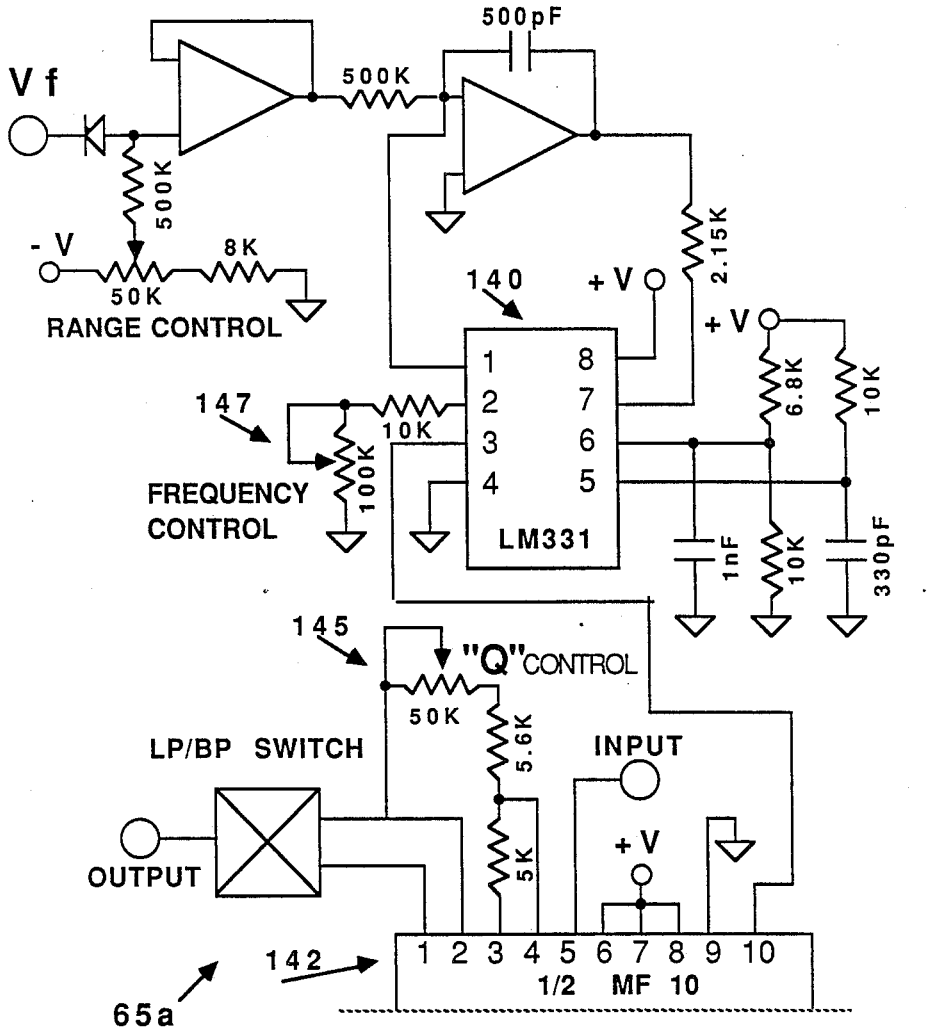
Figure 14:
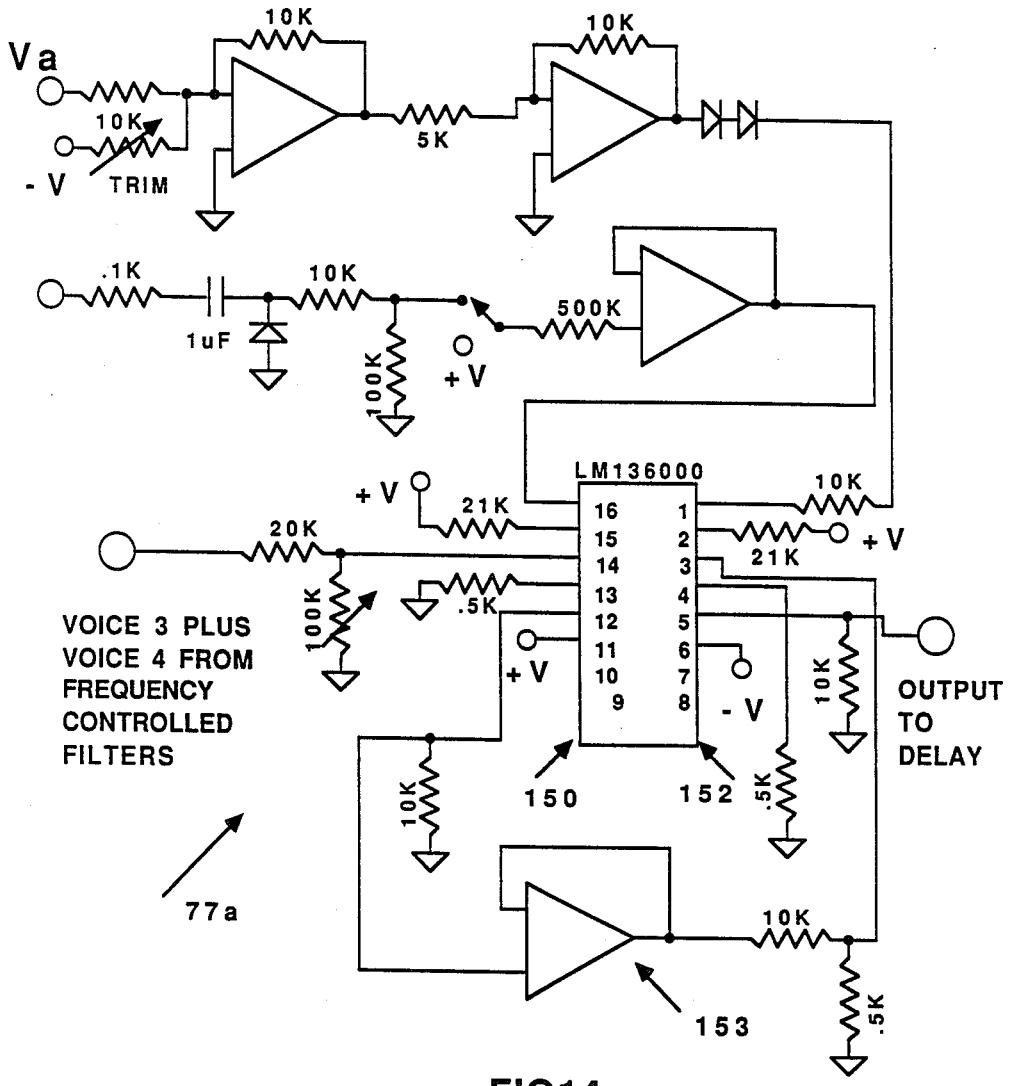
Figure 15:
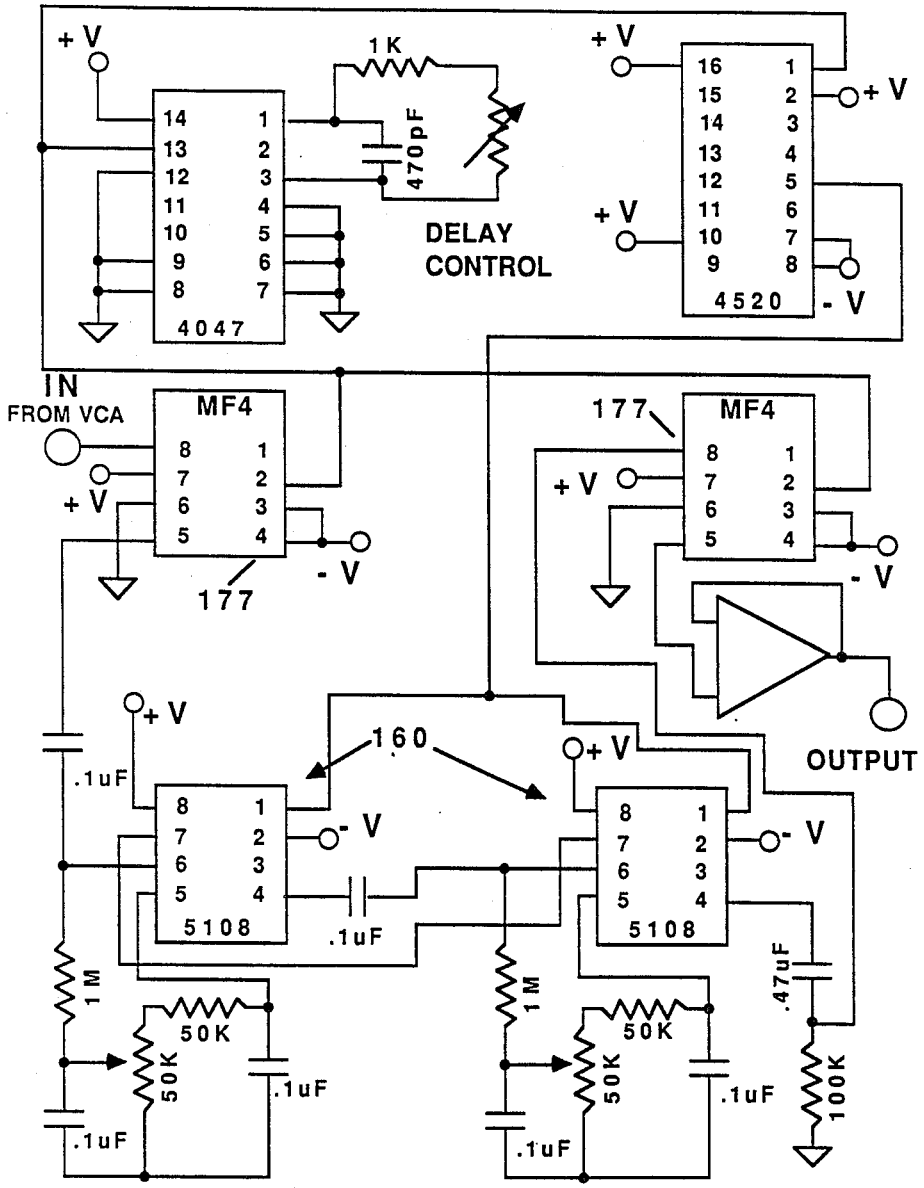

FIG. 12 is a circuit schematic of adder 133 in mixer 60*b*. FIG. 13 is a circuit schematic of frequency-controlled filter 65*a* for voice 2. The frequency-controlled filters 65*b* for voices 3 and 4 would be substantially the same. FIG. 14 is a circuit schematic of VCA 70*a* and note attack control circuit 77*a*. FIG. 15 is a circuit schematic of delay circuitry 75*a*.

Instrument Performance

Figure 16:
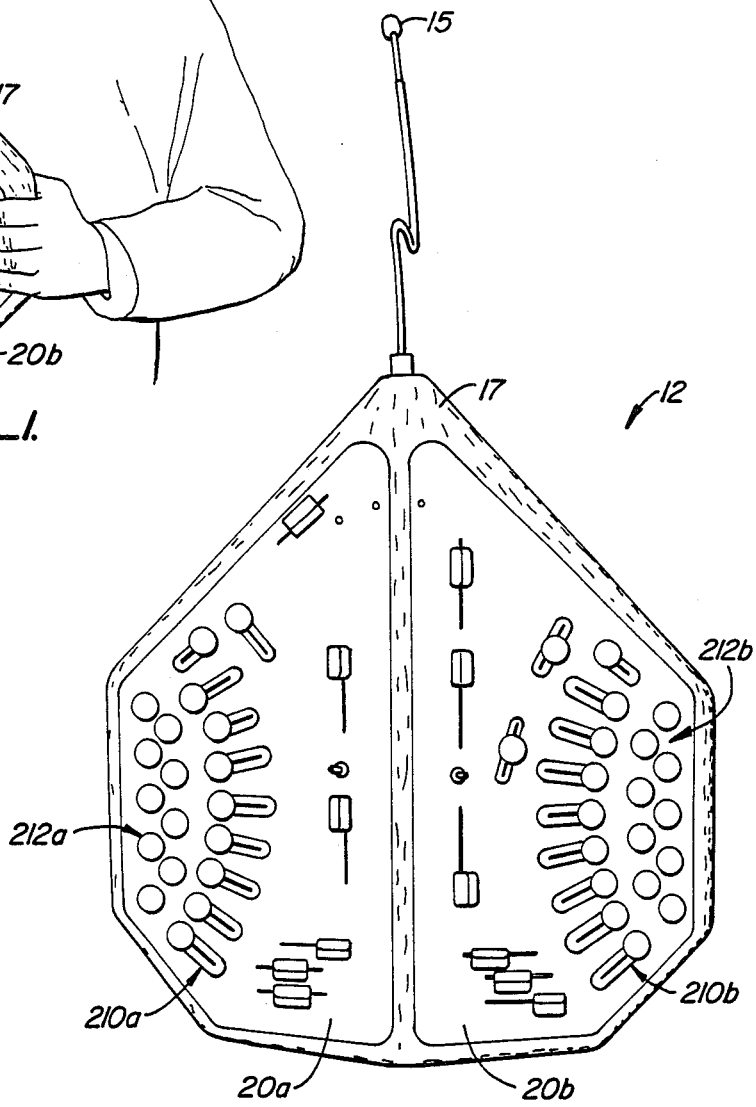
FIG. 16 is a front elevational view of the instrument.

FIG. 16 is a front elevational view of instrument 12, illustrating the basic layout of control panels 20*a–b*. The instrument is of generally symmetrical configuration, with control panels 20*a* and 20*b* being close to mirror images of each other. The player manipulates the controls on panel 20*a* with his right hand to control voices 1 and 2, those on panel 20*b* with his left hand to control voices 3 and 4. FIGS. 17A and 17B are plan schematic views of panels 20*a* and 20*b*, illustrating the specific placement of the controls.

Most of the controls are slide potentiometers, which can be manipulated by the player during live performance. The controls are laid out ergonometrically, with sets of slide potentiometers 210*a* and 210*b* for controlling the mixer proportions and voice filters arranged to lie naturally under the player's fingertips. Sets of momentary contact switches 212*a* and 212*b* are arranged near the mixer switches to allow the player to eliminate certain voice component signals from the voice signals without having to disturb the potentiometer settings. The delay controls are located generally near the bottom of the instrument while a number of other controls are located near the center.

As discussed above, the voice component signals are grouped into a number of subsets, each of which defines one of the instrument voices. Each voice has its own particular attributes and is controllable to a certain extent independently from the other voices. The following verbal descriptions of the voice sounds, while necessarily imprecise, do provide insight into the underlying design philosophy of the instrument and provide a sense of the versatility of the instrument. It should be remembered, however, that comparisons with the sounds of conventional instruments are at best suggestive of the actual sounds.

Voice 1, which consists of sine waves at $\frac{1}{2}$, $\frac{1}{4}$, and $\frac{1}{8}$ the fundamental, provides a round sound. There are no odd harmonics, so the sound is rather open and somewhat unconnected. When used with a long delay, voice 1 creates the sensation of being produced in a large room.

Voice 2, which consists of square waves at $\frac{1}{2}$, $\frac{1}{4}$, $\frac{1}{8}$, and 1/16 the fundamental, provides a jazzy, brassy sound. It is a more mixed voice due to the presence of the odd harmonics in the square waves. Sweeping the center frequency on the filters while maintaining the fundamental frequency constant produces a fluctuating muted effect similar to that produced with a "wah-wah" mute on a brass instrument. Voice 2 can be rendered boomy or percussive by use of the note attack control.

Voice 3, which consists of a square wave at $\frac{1}{8}$ the fundamental and both sine and square waves at 1/16 the fundamental frequency, is the bass voice for the instrument. The result is a deep, organ-like sound. Voice 3 repeats the square waves of voice 2, and can produce contrasting effects when the voices are filtered differently.

Voice 4, which consists of a sine wave at $\frac{1}{3}$ the fundamental and square waves at 1/5, 1/6, and 1/10 the fundamental, has a sufficiently wide range of harmonics that it can sound discordant or harmonious depending on the mix and the filtering. Given that the frequency ratios define a just intonation, the intervals sound rather different from a normal piano (which is equal tempered). Voice 4 is used mainly for counterpoint and special effects. On one hand, introducing all the components produces noisy, drum-like signal. When played with the staccato effect provided by the note attack control, this can be used to provide a sort of rhythmic accompaniment. On the other hand, the pure tone at $\frac{1}{3}$ the fundamental, when combined with the pure tone at $\frac{1}{2}$ the fundamental from voice 1, gives a pure interval that creates an effect reminiscent of Twelfth Century music.

Conclusion

In conclusion, it can be seen that the present invention gives the whistler the capability to make music beyond the thin and immaterial range imposed by human anatomy. The music from the present invention may rise as a Pan flute, chime like an early Renaissance tambourine, sing like a Gregorian chant, rock like an electric guitar, beat like a drum, or thunder like a church organ. At the same time, the instrument of the present invention has its own unmistakable voice unlike any other.

While the above is a complete disclosure of the present invention, various modifications, alternate constructions, and equivalents may be used. For example, while the particular embodiment utilizes sine waves and square waves as the voice component signals, other wave forms such as sawtooths, ramps, and pulses could be used. Similarly, while a four-voice instrument is disclosed, a simpler version utilizing voices 1 and 2 would still provide the player with extreme versatility. Moreover, with further developments in electronics those skilled in the art will be able to devise other circuit designs achieving the functions and satisfying the time correlation requirements taught by the present specification. Therefore, the above description and illustrations should not be taken as limiting the scope of the present invention which is defined by the appended claims.

I claim:

1. An electronic musical instrument comprising:

whistle processing means, responsive to a whistle signal representative of a human whistling, for producing a plurality of signals directly representative of said whistling, said signals including a square wave, referred to as the frequency reference signal, having zero crossings corresponding to the zero crossings of said whistle signal, a voltage level, referred to as the frequency of said whistle signal, an analog signal, referred to as the amplitude envelope signal, representative of the amplitude envelope of said whistle signal, and a digital signal, referred to as the note-on signal, which is asserted when said whistle signal is present above a particular threshold;

voice component generator means responsive to said frequency reference signal, said note-on signal, and said frequency voltage, for generating a set of signals, referred to as voice component signals, at selected subharmonics of said frequency reference signal, said set including at least one substantially sinusoidal signal and at least one non-sinusoidal periodic signal;

superposition means for providing a voice signal, which voice signal includes a combination of a predetermined subset of said voice component signals, said superposition means including first user control means for adjusting the relative proportions of voice component signals within said predetermined subset;

harmonic control means, responsive to said voice signal and said frequency voltage, for providing a filtered voice signal having altered harmonic content, said harmonic control means including a frequency-controlled filter operable to track the fundamental frequency of said frequency reference signal, and further controllable by the user to selectively pass a desired set of harmonics of said voice component signals;

amplitude modulation means, responsive to said filtered voice signal, said amplitude envelope signal, and said note-on signal, for shaping the time evolution of said filtered voice signal within the time interval during which said note-on signal is asserted; and note prolongation means, responsive to the output of said modulation means, for shaping the time evolution thereof after said note-on signal is withdrawn.

2. The instrument of claim 1 wherein said whistle processing means comprises:

a microphone amplifier for producing an output representing said whistle signal;

a zero crossing detector, responsive to the output of said microphone amplifier, for producing said frequency reference signal;

an AC-to-DC convertor, responsive to the output of said microphone amplifier, for producing said amplitude envelope signal;

a frequency-to-voltage convertor, responsive to said frequency reference signal, for producing said frequency voltage; and a note on/off detector, responsive to said frequency reference signal and said frequency voltage, for producing said note-on signal.

3. The instrument of claim 1 wherein said voice component generator means comprises:

a frequency divider, responsive to said frequency reference signal, for producing a number of square waves at the selected subharmonics of said frequency reference signal; and a waveform shaper, responsive to said square waves, said frequency voltage, and said note-on signal, for producing substantially sinusoidal signals representative of at least one of said subharmonic square waves, and for referring said voice component signals to ground potential substantially as soon as said note-on signal is withdrawn.

4. The instrument of claim 1 wherein said superposition means comprises a resistive adder with potentiometer controls to define said first user control means.

5. The instrument of claim 1 wherein said amplitude modulation means comprises:

means for impressing said amplitude envelope signal on said filtered voice signal;

means for generating a transient signal at the beginning of the assertion of said note-on signal; and means for selectively impressing said transient signal on said filtered voice signal.

6. The instrument of claim 1 wherein said note prolongation means comprises:

delay means for producing a delayed version of the output of said modulation means in addition to an undelayed version thereof; and means for selectively combining the delayed version with the undelayed version to produce a reverberation effect to shape the decay characteristics of the note.

7. An electronic musical instrument comprising:

whistle processing means, responsive to a whistle signal representative of a human whistling, for producing a plurality of signals directly representative of said whistling, said signals including a square wave, referred to as the frequency reference signal, having zero crossings corresponding to the zero crossings of said whistle signal, a voltage level, referred to as the frequency voltage, corresponding to the fundamental frequency of said whistle signal, an analog signal, referred to as the amplitude envelope signal, representative of the amplitude envelope of said whistle signal, and a digital signal, referred to as the note-on signal, which is asserted when said whistle signal is present above a particular threshold;

voice component generator means responsive to said frequency reference signal, said note-on signal, and said frequency voltage, for generating a set of signals, referred to as voice component signals, at selected subharmonics of said frequency reference signal, said set including at least one substantially sinusoidal signal and at least one non-sinusoidal periodic signal;

superposition means for providing a voice signal, which voice signal includes a combination of a predetermined subset of said voice component signals, said superposition means including first user control means for adjusting the relative proportions of voice component signals within said predetermined subset;

harmonic control means, responsive to said voice signal and said frequency voltage, for providing a filtered voice signal having altered harmonic content, said harmonic control means including second user control means for adjusting the nature of the alteration of the harmonic content;

means for impressing said amplitude envelope signal on said filtered voice signal;

means for generating a transient signal at the beginning of the assertion of said note-on signal;

means for selectively impressing said transient signal on said filtered voice signal; and note prolongation means for shaping the time evolution thereof after said note-on signal is withdrawn.

8. An electronic musical instrument comprising:

microphone means, responsive to a human whistling, for producing an analog electrical signal representative of said whistling, said analog signal being referred to as the whistle signal;

zero crossing detector means, responsive to said whistle signal, for producing a square wave, referred to as the frequency reference signal, having zero crossings directly corresponding to the zero crossings of said whistle signal;

means, responsive to said frequency reference signal for providing a set of signals, referred to as voice component signals, at selected subharmonics of said frequency reference signal, said set including at least one substantially sinusoidal signal and at least one non-sinusoidal periodic signal;

first superposition means for providing a first voice signal, which first voice signal includes a superposition of a first predetermined subset of said voice component signals, said first superposition means including user-controllable means for adjusting the relative proportions of voice component signals within said first predetermined subset and thereby provide a first filtered voice signal;

second superposition means for providing a second voice signal, which second voice signal includes a combination of a second predetermined subset of said voice component signals, said second superposition means including user-controllable means for adjusting the relative proportions of voice component signals within said second predetermined subset and thereby provide a second filtered voice signal;

envelope generator means, responsive to said whistle signal, for providing a signal, referred to as the whistle envelope signal, representative of the amplitude envelope of said whistle signal;

means for impressing said amplitude envelope signal on said first and second filtered voice signals;

means for generating at least one transient signal at the beginning of the assertion of said note-on signal;

means for selectively impressing said at least one transient signal on said first and second filtered voice signals; and user-controllable prolongation means for shaping the decay characteristics of said modulated signals.

9. The instrument of claim 8, and further comprising:

frequency-controlled filter means for removing selected frequencies from at least one of said voice signals.

10. The instrument of claim 8, and further comprising:

note detector means, responsive to at least one signal derived from said whistle signal, for providing a note-on signal exhibiting a first state when said whistle signal is present and a second state when said whistle signal is absent;

attack means, responsive to said note-on signal, for providing an alternate envelope signal; and means, coupled to said attack means, adapted for modulating said voice signals according to said alternate envelope signal.

11. The instrument of claim 8, wherein the frequencies of said voice component signals include divisions by 2, 3, 4, 5, 6, 8, 10, and 16 relative to the frequency of said frequency reference signal.

12. The instrument of claim 11 wherein said first voice signal includes only sinusoidal voice component signals.

* * * * *